US008783239B2

(12) United States Patent
Vyprachticky

(10) Patent No.: US 8,783,239 B2
(45) Date of Patent: Jul. 22, 2014

(54) PIVOTAL HANDLE FOR ARCHERY BOW

(71) Applicant: Emil Vyprachticky, Arvada, CO (US)

(72) Inventor: Emil Vyprachticky, Arvada, CO (US)

( * ) Notice: Subject to any disclaimer, the term of this patent is extended or adjusted under 35 U.S.C. 154(b) by 68 days.

(21) Appl. No.: 13/722,299

(22) Filed: Dec. 20, 2012

(65) Prior Publication Data

US 2014/0174417 A1 Jun. 26, 2014

(51) Int. Cl.
*F41B 5/00* (2006.01)
*F41B 5/14* (2006.01)

(52) U.S. Cl.
CPC ..... *F41B 5/14* (2013.01)
USPC ..... 124/88

(58) Field of Classification Search
CPC ..... F41B 5/10; F41B 5/14
USPC ..... 124/23.1, 25.6, 86, 88
See application file for complete search history.

(56) References Cited

U.S. PATENT DOCUMENTS 4,966,124 A * 10/1990 Burling ..... 124/23.1
5,241,945 A * 9/1993 Shepley, Jr. ..... 124/88
5,469,834 A * 11/1995 Higgins et al. ..... 124/88
5,842,460 A * 12/1998 Barber ..... 124/88

* cited by examiner

*Primary Examiner* — John Ricci

(57) ABSTRACT

The present invention is a self-aligning archery bow that has upper and lower risers and a grip intermediate the risers. A U-shaped handle overlying the grip is pivotally attached to the grip whereby the handle pivots about vertical axes in response to torque on the bow produced by force on the draw string, thus compensating for the tendency of the bow and the grip to twist in the hand of the archer. The pivotal movement of the handle is accommodated through a plurality of ball bearings that operatively engage the grip and the handle, and a pivotal bolt that connects the handle to the grip.

11 Claims, 8 Drawing Sheets

PIVOTAL HANDLE FOR ARCHERY BOW

FIELD OF THE INVENTION

The present invention relates to archery bows and more specifically to a pivotal handle that attaches to the integral bow grip intermediate the risers.

BACKGROUND OF THE INVENTION

Especially in bows of higher draw strength, drawing the string of a bow produces torque or a tendency for the bow grip to twist in the hand of the archer. When the arrow is released the torque twists the grip in the opposite direction causing deflection of the arrow path or oscillation of the arrow, both of which affect the accuracy of the shot. Although thicker grip sections are desirable from the comfort standpoint, such thicker sections act to increase hand contact and the consequent torque on the bow. To eliminate this amplified torque tendency, the conventional wisdom is to make the grip section of the riser narrow and thin, thus reducing the amount of hand contact with the bow. While this solution may reduce the torque on the bow, thin grips are uncomfortable and more difficult to grasp securely. Accordingly, one object of the present invention is to provide a thicker and more comfortable archery bow handle, but at the same time reduce the effect of torque on the bow.

The problem created by bow torque has been recognized in U.S. Pat. No. 6,988,495 for Bow Grip Assembly. This disclosure represents one effort to solve the problem. The '495 patent provides a pivotal handgrip that is mounted to the bow by an intermediate device that is snap fitted onto the bow over a bearing assembly that is attached to the bow riser. While the bow grip of the '495 achieves its stated objectives, the needle bearings that are a basic element of the bearing assembly can not tolerate the forces created in high draw strength bows.

Accordingly, it is another object of the present invention to provide a pivotable handle for an archery bow that relies exclusively on high strength ball bearings to support the handgrip's pivotal function in high draw strength bows.

SUMMARY OF THE INVENTION

The pivotable handle for an archery bow of the present invention includes a generally U shaped handle adapted to overlay the side and rear surfaces of the ordinary bow grip which is integral with and positioned intermediate the upper and lower bow risers. The handle is spaced apart from the lateral side surfaces of the bow grip. The ordinary bow grip is modified to include at least two hemispherical sockets disposed on vertically and horizontally spaced apart mounting platforms on the rear surface of the grip. Hardened spherical ball bearings are disposed in each of the hemispherical sockets. The interior rear surface of the U shaped handle contains similar spaced apart hemispherical sockets adapted to seat the respective spherical balls that are disposed in the bow grip sockets. A fastening bolt pivotally interconnects the bow grip and the handle so that the fastener pivots in a plane perpendicular to the plane of the grip and the bow risers, allowing the handle to pivot about at least two vertical axes on the at least two spherical bearings. Thus, instead of the handle twisting in the hand of the shooter, the handle remains stationary while the bow pivots or rotates within the handle in response to the torque on the bow.

DETAILED DESCRIPTION OF PREFERRED EMBODIMENT

Figure 1:
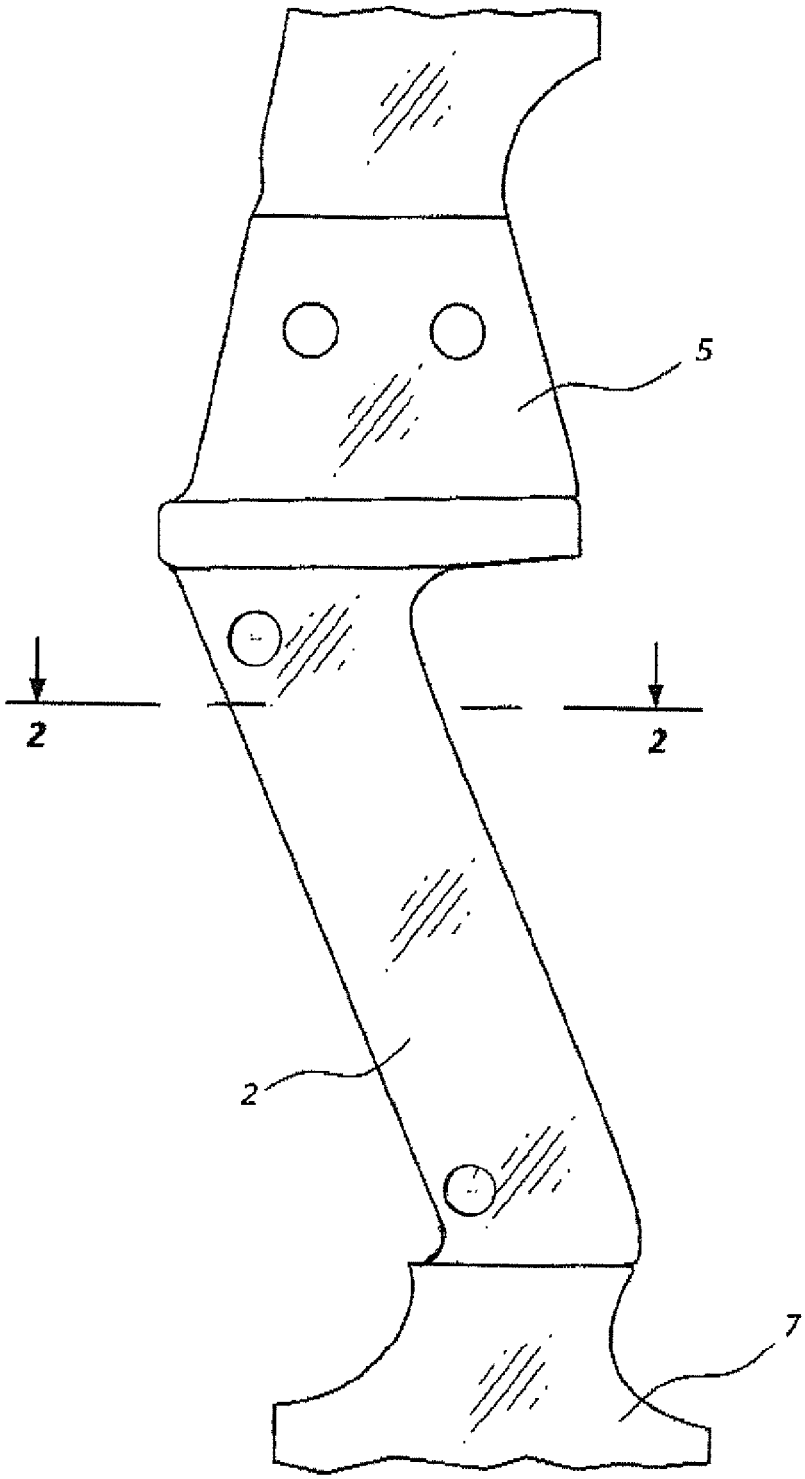
FIG. 1 is a fragmentary side view of a typical bow grip that is integral with the upper and lower bow risers.
Figure 2:
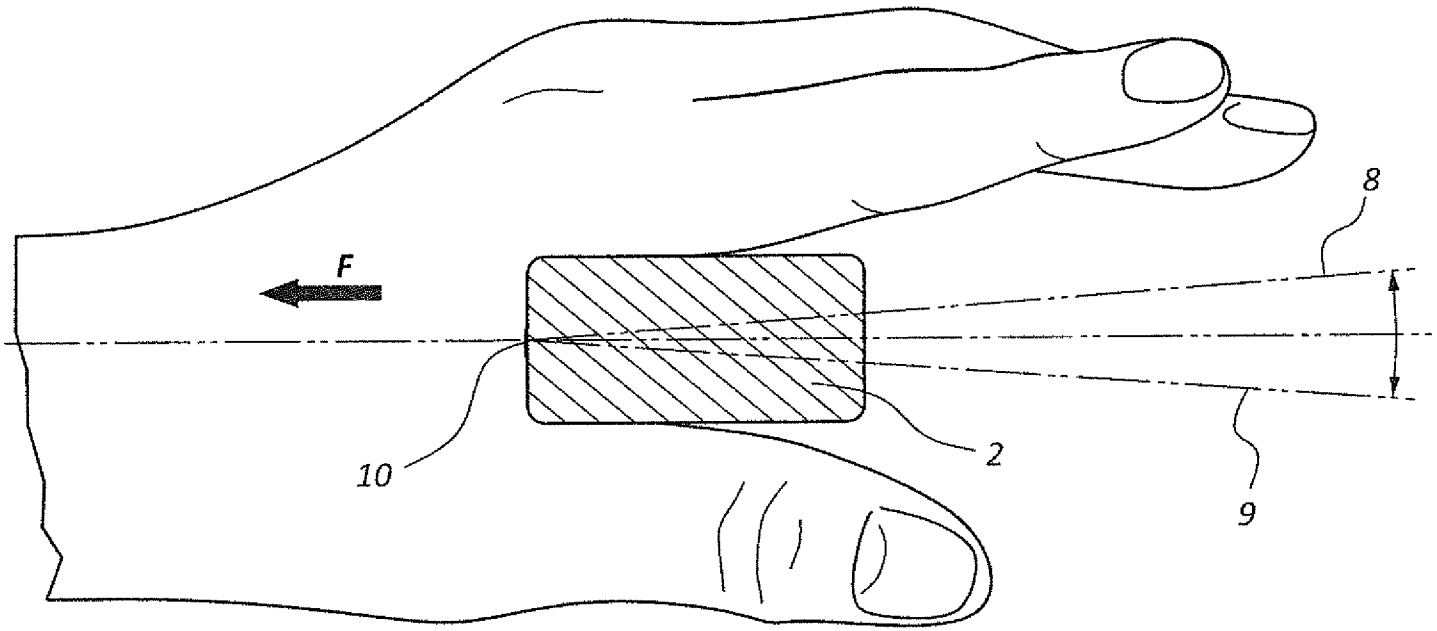
FIG. 2 is a cross sectional view of the bow grip of FIG. 1, taken along lines 2-2 of FIG. 1, and showing the hand of an archer grasping the bow grip. Dashed lines illustrate the direction of twisting of the grip in the hand of the archer that is caused by torque on the bow that is created by draw string force.

The grip section 2 of a typical archery bow is shown in FIG. 1 as being integrally disposed between the upper and lower bow risers 5 and 7. A cross sectional view of the grip section is shown in FIG. 2 as it would appear in the hand of an archer. Dotted lines 8 and 9 emanating at angles from the center of the rotation 10 illustrate the possible angular twist of the grip 2 that is produced by draw string torque on the bow.

Figure 3:
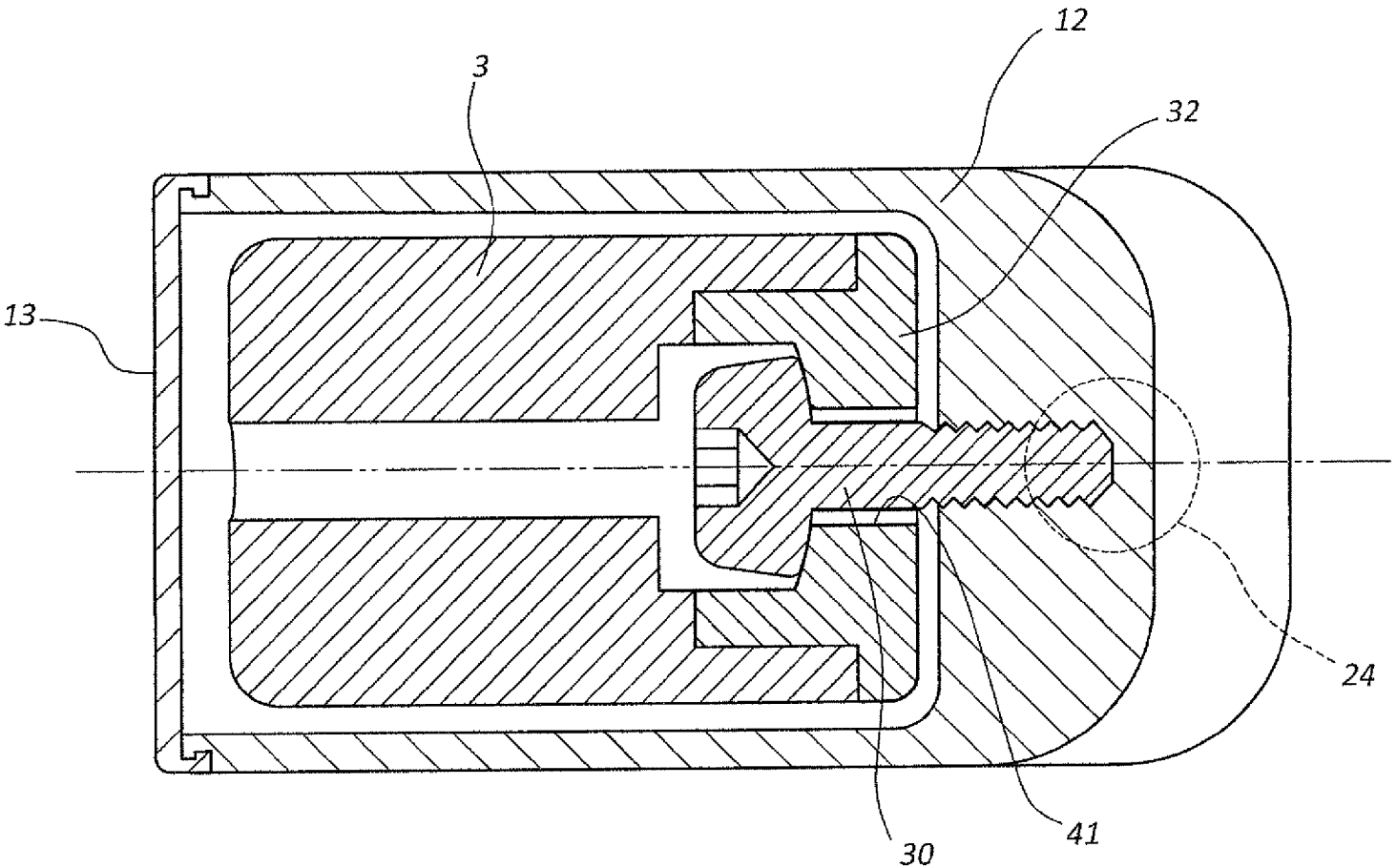
FIG. 3 is a cross sectional view of the archery bow of the present invention, taken along lines 3-3 of FIG. 5.

The pivotal handle 12 of the present invention is illustrated in FIG. 3 in its position overlaying a modified bow grip 3.

Figure 5:
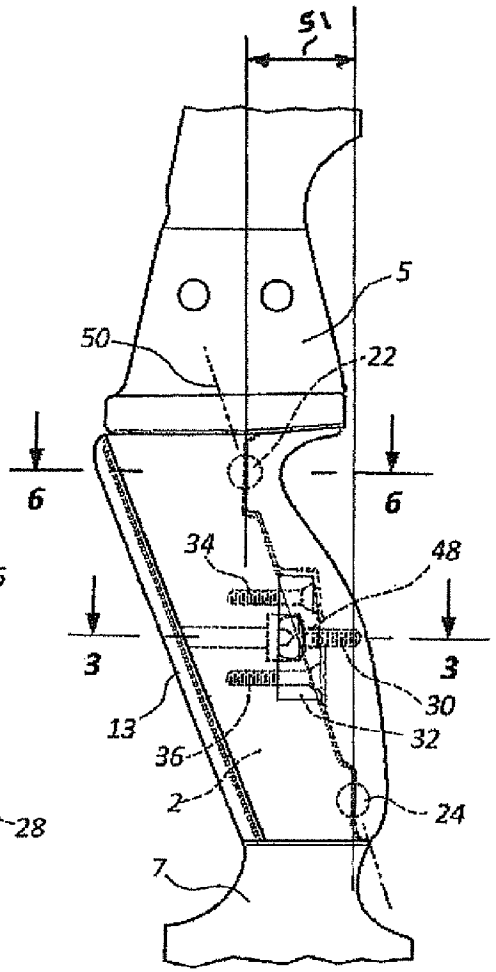
FIG. 5 is a side view of the pivotal handle of the present invention and showing the grip/handle interconnection fastener and supporting pivot bearings in dotted lines.
Figure 4:
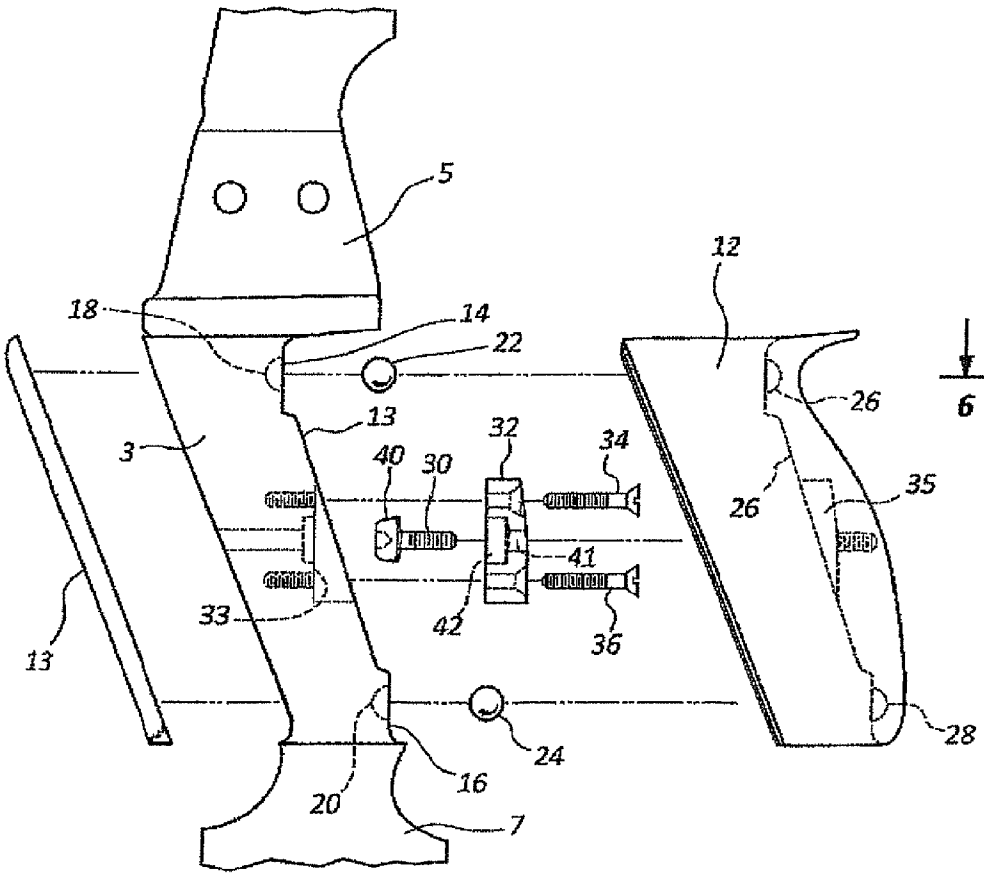
FIG. 4 is an exploded side view of the modified bow grip and the pivotal handle and showing the ball bearings and the bolt fastener that interconnects the bow grip and the handle of the present invention.
Figure 6:
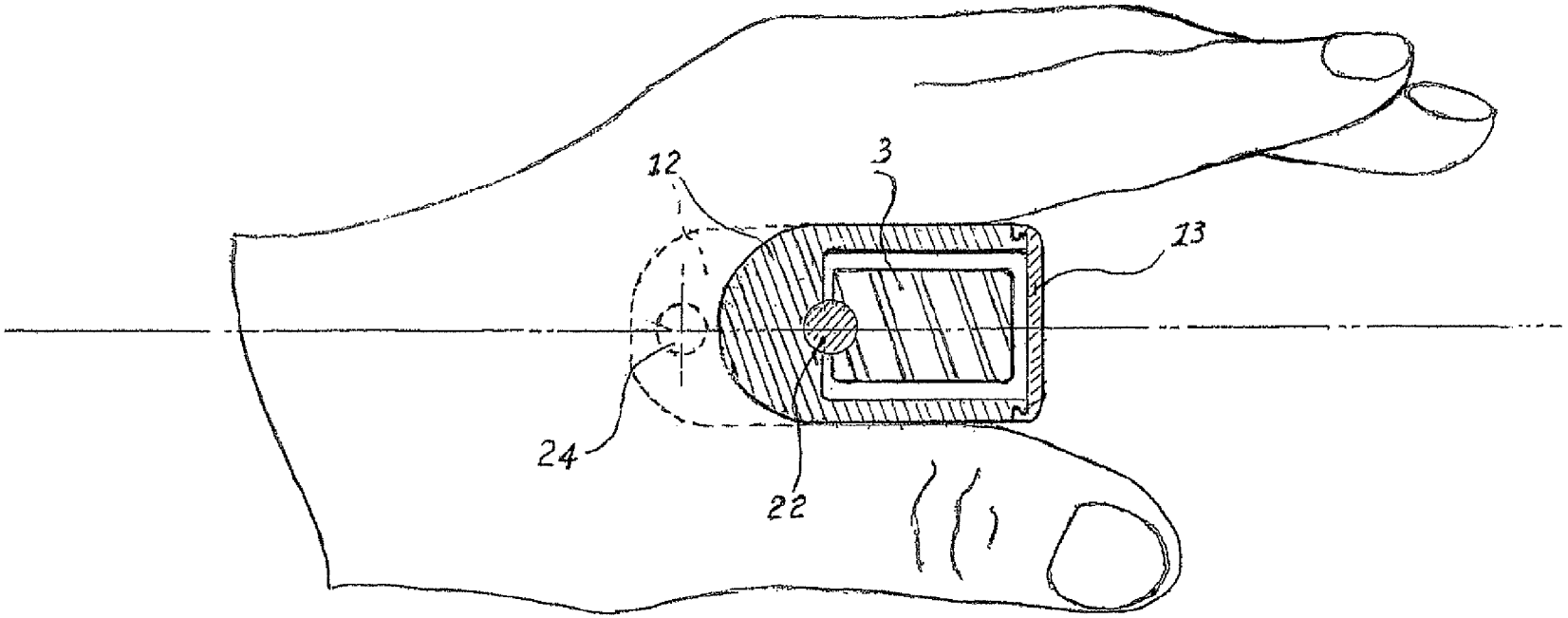
FIG. 6 is a cross sectional view taken along lines 6-6 of FIG. 5 showing the hand of an archer grasping the pivotal handle in a neutral force position with no draw string force applied.

As shown in FIGS. 4 and 5, the modified bow grip 3 is provided on its flat rear surface 13 with vertically and horizontally spaced apart upper and lower vertically oriented platforms 14 and 16. Each of the platforms contains a hemispherical socket 18 and 20 that accommodates respective ball bearings 22 and 24. The rear interior surface 26 of the handle 12 is also provided with spaced apart ball bearing seats 26 and 28 that receive the respective bearings 22 and 24. The bearings provide the pivotal foundation for the handle 12.

Figure 8:
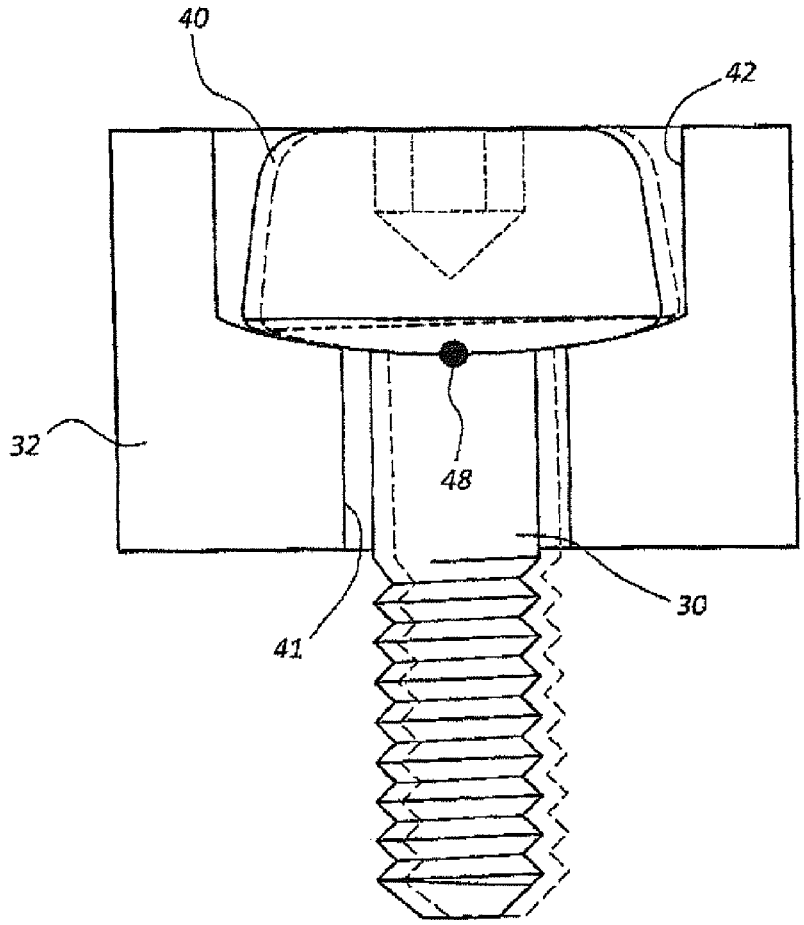
FIG. 8 is a partial enlarged cross sectional view, similar to FIG. 3, taken along lines 3-3 of FIG. 4. The view shows only the mounting block and the fastening bolt in order to illustrate the pivotal movement of the fastening bolt that interconnects the bow grip and the handle.

The handle 12 is attached to the bow grip 3 through a pivotally disposed socket head bolt 30 which is journaled in a mounting block 32 whose forward facing side is seated in a recess 33 in the rear facing surface of the bow grip 3 and is connected to the grip with screws 34 and 36. The rearward facing side of the mounting block 32 is disposed within a recess 35 in the inside surface of the handle 12. The head 40 of the bolt 30 is disposed in an oversized countersunk recess 42 in the frontal side of the mounting block 32, as shown in FIGS. 3, 4 and 8. The threaded shank of the screw 30 passes through a diametrically enlarged bore 41 in the block 32 and threadingly engages the inside surface of the handle 12. The screw 30 secures the handle 12 to the grip, while at the same time allowing the handle to pivot on the bearings in a plane perpendicular to the plane of the bow, within the confines of the oversized countersunk recess and the enlarged bore in the mounting block 32, as illustrated in FIG. 8.

The crucial problem to be overcome in retrofitting a traditional bow grip with the pivotal handle of the present invention is to create a hinge system on a sloping surface 13 that will allow the grip to pivot around a vertical axis. The problem is solved by the provision in the present invention of several significant features. First the bearings 22 and 24 are seated in recesses 18 and 20 which are disposed in vertically oriented platforms that match opposing vertical platforms 23 and 25 in the interior surface 26 of the pivotal handle 12. Second, there is a single point of pivotal connection, the bolt 30, between the bow grip 3 and the handle 12. Third, in order for the handle 12 to rotate about vertical axes and vertically displaced hinge or pivot points (bearings 22 and 24), the center point of the bearings must lie in a common plane and that plane must also pass through the pivot point 48 of the pivotal bolt 30. The common plane is depicted by line 50 in FIG. 5. An added feature of the horizontally spaced apart bearings 22 and 24 is the increased breadth that the spaced apart pivot points provide for the arrow rest. In prior-art bows it is necessary for accuracy that the arrow rest be located in the same vertical plane as the single pivot point in the bow grip. However, with two horizontally spaced apart pivot points in the bow handle of the present invention (22 and 24) the arrow rest is broadened to that distance shown by reference numeral 51 in FIG. 5, that is, the horizontal distance between the vertical planes that intersect the respective centers of the bearings 22 and 24.

Figure 7:
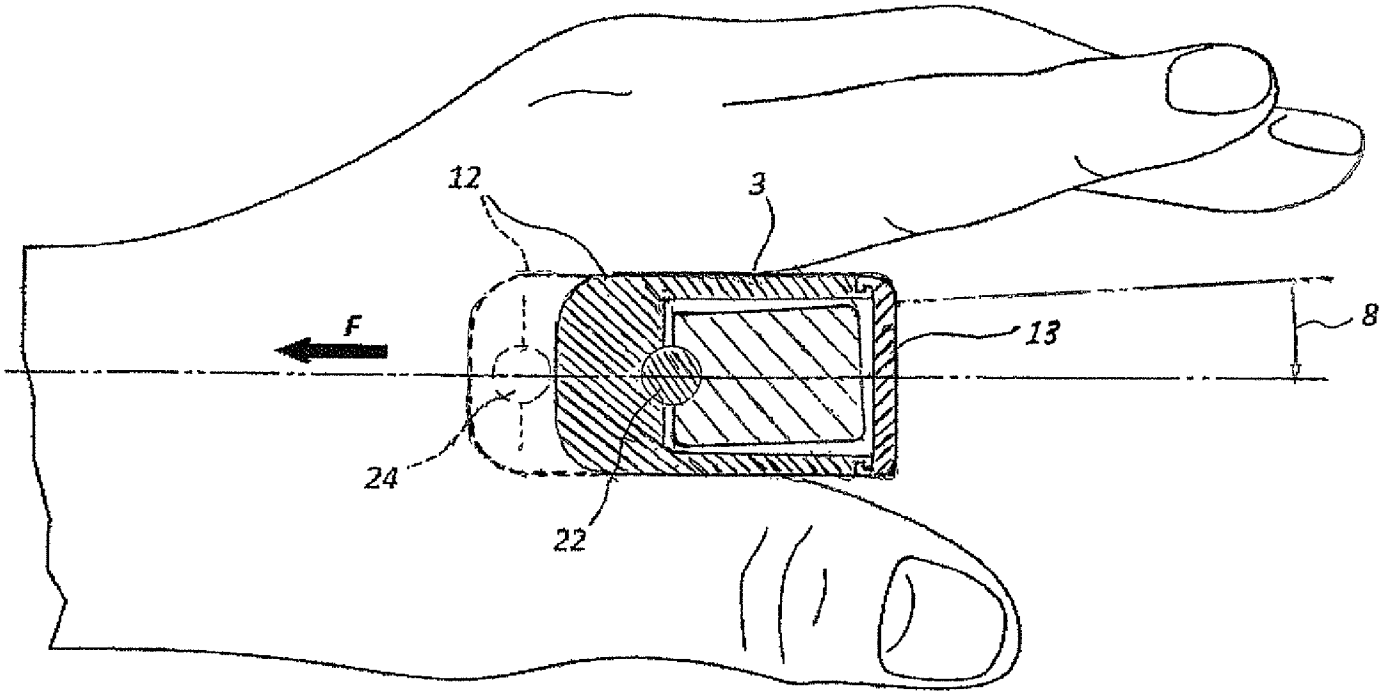
FIG. 7 is a cross sectional view taken along lines 6-6 of FIG. 5 when draw string force is applied that produces torque on the bow, allowing pivotal movement of the bow grip within the handle.

As shown in FIG. 7, the torque produced in the bow by force on the draw string will rotate the bow grip within the handle 12 while the handle does not twist or rotate within the hand of the shooter.

Figure 9:
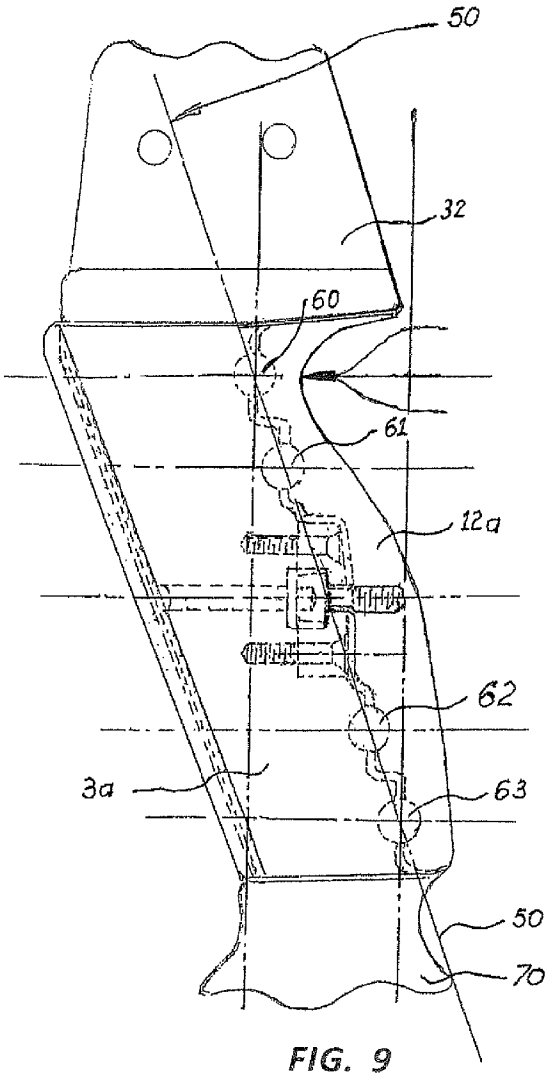
FIG. 9 is similar to FIG. 5 except that FIG. 9 illustrates a second embodiment having four bearings in order to tolerate higher draw string strength bows.

FIG. 9 of the drawings illustrates a second embodiment of the invention intended for use with very high draw strength bows. The difference between the preferred form and the second embodiment is the increase in bearing surfaces. Bearings 60, 61, 62 and 63 are disposed in hemispherical recess in separate spaced apart vertical platforms on the grip 3*a* of the bow. Similar bearing recesses are provided in the inside surface of the modified handle 12*a*. The bow grip and handle are interconnected in the same manner as shown and described for the preferred embodiment. The common plane 50 passes through the center of all of the bearings and the center of rotation 48 of the attachment bolt 30.

What is claimed is:

1. A pivotable handle for an archery bow having upper and lower risers comprising, a grip fixed to and positioned intermediate the upper and lower risers of the bow, where the grip includes a front surface, an inclined rear surface and spaced apart opposed lateral surfaces, at least two hemispherical pockets disposed on spaced apart vertically oriented bearing mounting platforms on the rear surface of the bow grip, a plurality of spherical ball bearings, each having a center point and disposed respectively in each of the hemispherical pockets, a generally U-shaped handle adapted to cover the rear surface of the fixed bow grip and to overlay and be spaced apart from the lateral side surfaces of the grip, said handle having a rear interior surface including spaced apart hemispherical pockets adapted to seat the respective ball bearings disposed in the bow grip pockets, pivotally movable fastening means having a pivot point for interconnecting the handle to the bow grip, where the fastening means pivots in a plane perpendicular to the plane of the bow grip and the upper and lower risers.

2. The pivotal handle of claim 1 where the fastening means includes a bolt having a truncated head.

3. The pivotal handle of claim 2 where the fastening means includes a base member secured to the rear surface of the bow grip intermediate the spaced apart bearing mounting platforms, said base member having a countersunk bore to embrace the head of the bolt.

4. The pivotal handle of claim 3 where the bolt threadingly engages the rear interior surface of the handle.

5. The pivotal handle of claim 4 where the bow grip includes a bore having a longitudinal axis aligned with the embraced cap screw, said bore opening on the front surface of the bow grip.

6. The pivotal handle of claim 5 and further including a slidable cover interconnecting the lateral sides of the grip and positioned to cover the front surface of the bow grip.

7. The pivotal handle of claim 1 where the center points of the ball bearings and the pivot point of the fastening means lie in a common plane.

8. A self-aligning archery bow having upper and lower risers and comprising, a grip intermediate the risers and integral therewith, said grip having flat lateral sides, a front surface and an inclined rear surfaces, a U-shaped handle overlaying the rear surface of the grip and spaced apart from its lateral sides, a plurality of ball bearings, each having a center point, operatively engaging the handle and the inclined rear surface of the grip, and fastening means for pivotally interconnecting the handle to the grip where the fastening means includes a pivotal center point.

9. The archery bow of claim 8 where the ball bearings are vertically and horizontally spaced apart.

10. The archery bow of claim 9 where the center points of the ball bearings and the pivotal center point of the fastening means lie in a common plane.

11. The archery bow of claim 10 where the fastening means includes a mounting block carried by the rear surface of the grip and a bolt pivotally disposed in the mounting block and secured into the handle.

* * * * *